US005947366A

United States Patent [19]

Feldmann et al.

[11] Patent Number: 5,947,366

[45] Date of Patent: Sep. 7, 1999

[54] CONTAINER MADE FROM A CARDBOARD BLANK FOR ARTICLES OF CLOTHING

[75] Inventors: André Feldmann; Arne Jacob Schultchen, both of Hamburg, Germany

[73] Assignee: Stefan Schulz, Hamburg, Germany

[21] Appl. No.: 08/973,156

[22] PCT Filed: May 31, 1996

[86] PCT No.: PCT/EP96/02351

§ 371 Date: Feb. 19, 1998

§ 102(e) Date: Feb. 19, 1998

[87] PCT Pub. No.: WO96/39344

PCT Pub. Date: Dec. 12, 1996

[30] Foreign Application Priority Data

Jun. 3, 1995 [DE] Germany ..... 295 09 239 U

[51] Int. Cl.[6] ..... B65D 75/00

[52] U.S. Cl. ..... 229/87.17; 206/278

[58] Field of Search ..... 206/278, 292, 206/282, 294, 295; 229/87.17, 87.15, 87.16, 92.3, 87.01, 103.2, 119, 120, 117.18, 117.09

[56] References Cited

U.S. PATENT DOCUMENTS

| | | | |
|---|---|---|---|
| 886,796 | 5/1908 | Goodman | 229/87.17 |
| 1,018,905 | 2/1912 | Herman | 229/87.17 |
| 1,315,516 | 9/1919 | Korfist | 206/294 X |
| 1,720,679 | 7/1929 | Karn | 206/295 |
| 1,994,382 | 3/1935 | Berger | 206/278 |
| 2,128,421 | 8/1938 | Lewenberg | 229/87.17 |
| 2,334,786 | 11/1943 | Myers | 229/152 |
| 2,608,292 | 8/1952 | Stensgaard | 206/294 X |
| 2,619,226 | 11/1952 | Adams | 229/103.2 |
| 3,149,718 | 9/1964 | Wolf | 229/152 |
| 3,253,703 | 5/1966 | Ettin | 229/103.2 |
| 3,664,572 | 5/1972 | Puchkoff et al. | 229/87.17 X |
| 3,901,001 | 8/1975 | Glaze, Jr. | 206/278 X |
| 4,140,218 | 2/1979 | Forte | 229/103.2 X |
| 4,206,869 | 6/1980 | Gurevitz | 229/117.18 |
| 5,027,945 | 7/1991 | Wilkins | 206/292 X |
| 5,240,173 | 8/1993 | Dagostine | 229/103.2 |

*Primary Examiner*—Gary E. Elkins
*Assistant Examiner*—Tri M. Mai
*Attorney, Agent, or Firm*—Lane, Aitken & McCann, L.L.P.

[57] ABSTRACT

The invention concerns a container made from a cardboard blank and intended for articles of clothing, in particular pullovers, T-shirts and the like. It comprises a front section with a flap section joined by an intermediate section via fold lines, a rear section with a flap section joined via a fold line, and an intermediate section which connects the front section and rear section and is provided with a grip- or view-hole. The front section is provided in one of its edge regions with a pop-up flap unit formed by an incompletely closed cut line, preferably an arc of about 300°.

6 Claims, 2 Drawing Sheets

CONTAINER MADE FROM A CARDBOARD BLANK FOR ARTICLES OF CLOTHING

The invention relates to a container made from a cardboard blank for articles of clothing, in particular sweaters, T-shirts, and the like, having a front section with a flap section joined by an intermediate section by way of fold lines, a rear section with a flap section joined by way of a told line, and an intermediate section with a grip hole or view hole connecting the front section to the rear section.

A folding container such as this is already known (U.S. Pat. No. 1,720,679), although it is not provided with a grip or view hole.

A folding container such as this is already known (U.S. Pat. No. 1,720,679), although it is not provided with a grip or view hole.

Such containers represent the state of the art but are used exclusively for transportation of articles of clothing from the clothing manufacturer to a sales outlet, where they are removed from the packaging and presented to the end user in a display case or are stacked on a shelf.

The object of the invention is to design a container such as that described in the foregoing so that it will be suitable both for transportation of articles of clothing and for presentation to the end user for sale.

This is achieved in that the front section has a popup flap unit in the area of one of its ends. This flap unit is formed by an incompletely closed cut line, preferably with an arc of approximately 300°.

The solution offered by this invention is based on the principle of providing the front section of a cardboard container in board form with an opening through which the article of clothing, and in particular the sewn on labels of an article of clothing, are viewed as they face outward. The folding section positioned behind the opening serves as a support, among other things, for the article of clothing viewable as it faces outward.

The invention is explained in what follows with reference to an example illustrated in the drawing, the article of clothing being represented by a T-shirt.

Figure 1:
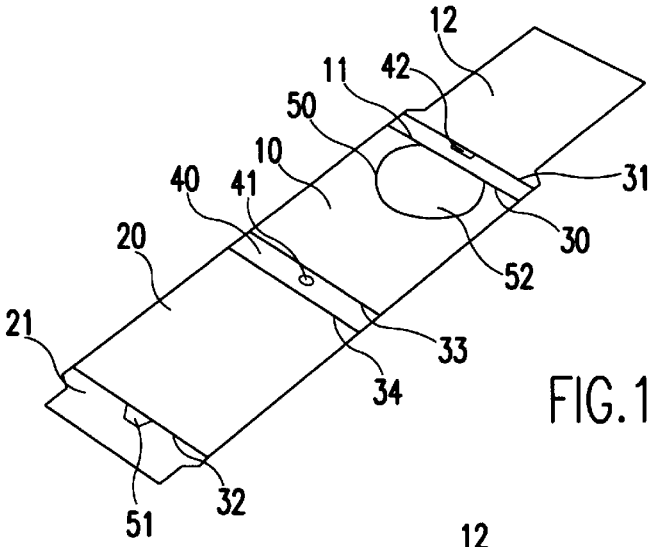
FIG. 1 shows a top view of the cardboard blank.

The figures present a cardboard blank, cardboard or the like such as is commercially available being used as the stock.

The cardboard blank is cut out, stamped, and prefolded in such a way that the container claimed for the invention is formed from the cardboard blank by simple repositioning processes.

When assembled the container is more or less in the form of a board, the long sides being designated as 10 and 20. The central sides of this board are open, that is, there is no cardboard blank section for this area.

Between container sides 10 and 20 there is an intermediate piece 40 connected to corresponding section 10 and 20 by way of fold lines 33 and 34. Analogously, there is provided on container side 10 an intermediate piece 11 of equal size which is connected to side section 10 by way of a fold line 30. The other boundary of intermediate piece 11 is fold line 31, on which there is a flap section 12.

On side section 20 there is provided, by way of a fold line 32, a flap section 21 provided with a punch out opening 51. Intermediate piece 11 is outfitted with a slotshaped cutout 42 and intermediate piece 40 with a round opening 41 in order to permit observation of the interior of the finished container.

Section 10 is provided with a cut 50 in the form of a semicircular arc, so that a fold out section 52 is formed, but one which may also be joined to section 10.

It is to be pointed out that all sections belong to a single cardboard blank and form one piece.

Figure 2:
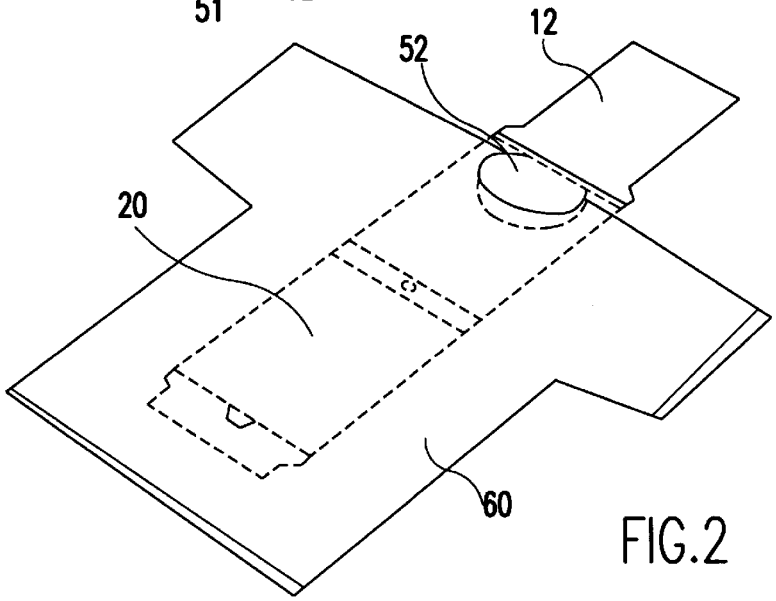
FIG. 2 is the same as FIG. 2, but with a T-shirt placed on the cardboard blank.

In the situation illustrated in FIG. 2, folding section 52 is folded out upward and a T-shirt 60 is placed on this flap unit 52, but on the cardboard blank itself.

Figure 3:
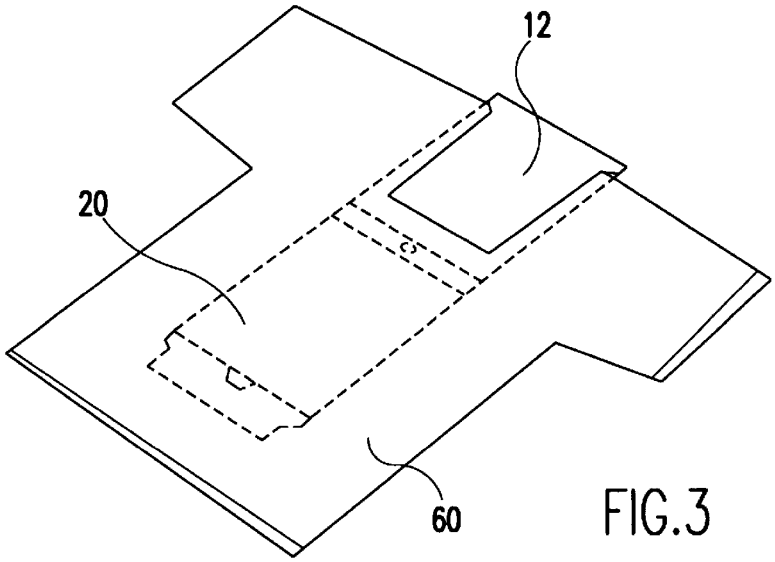
FIGS. 3 to 5 illustrate the process whereby the container is formed from the blank and the T-shirt is inserted into the container.

FIG. 3 illustrates how extension section 12 is rotated through 90° around fold line 31, the intermediate piece 11 also being rotated 90° around the fold line 30.

Figure 4:
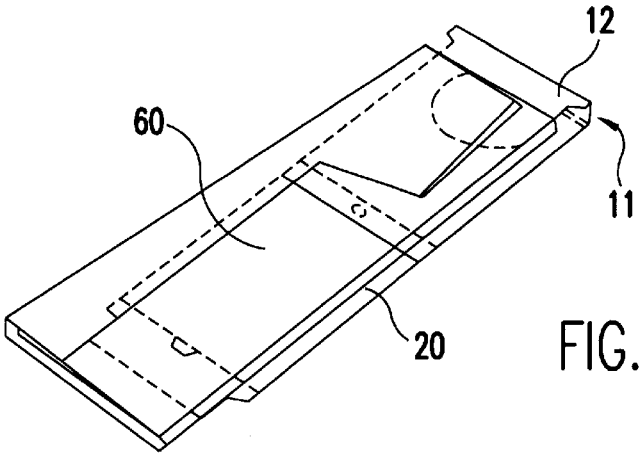
Figure 5:
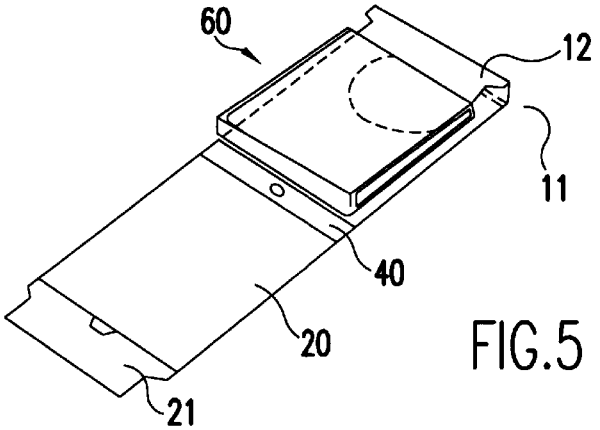
Figure 6:
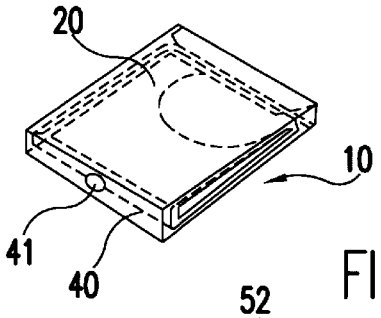
FIG. 6 shows the completed container as claimed for the invention, together with the article of clothing, as viewed from the bottom.

FIG. 4 shows the T-shirt first folded and then unfolded (FIG. 5). The side section 20 may now be rotated about 180° around the fold line 34 and intermediate piece 40 90° around fold line 33, after which section 21 is again rotated 90° around the fold line 32 and inserted into the finished cardboard (FIG. 6).

Figure 7:
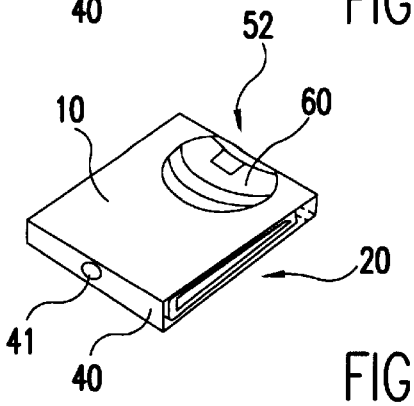
FIG. 7 is the same as FIG. 6, but shows the container claimed for the invention as viewed from the top.

It is to be seen from FIG. 7 how the T-shirt 60 may be seen from the outside through the opening 52. The illustration indicates how the T-shirt may be transported in the packaging but may also be presented to the end user on a shelf. It is advisable in stacking for the intermediate section 40 to be provided with an opening 41, preferably a circular opening, so that the color of the T-shirt may be recognized through this opening.

We claim:

1. A container for articles of clothing, the container being made from a cardboard blank comprising:

a front section;

a first flap section;

an intermediate piece connecting the first flap section to the front section, the intermediate piece having a first juncture with the first flap section and a second juncture with the front section, said first and second junctures comprising fold lines;

a rear section;

a second flap section connected with the rear section by way of a fold line; and an intermediate section connecting the front section with the rear section, the intermediate section defining an opening adapted for gripping and viewing, wherein the front section has an edge and a popup flap unit defined at said edge by a curved cut line, said curved cut line also defining an opening in said front section wherein said front section, said intermediate section and said rear section wrap around an article of clothing, and wherein said popup flap unit extends under a portion of the article of clothing, and a portion of said article of clothing is visible through the opening in said front section.

2. The container of claim 1, wherein the curved cut line extends through an arc of about 300°.

3. The container of claim 1, wherein the popup flap unit is connected to the rest of the front section at said second juncture.

4. The container of claim 1, wherein the rear section has unattached side edges extending from and generally transverse to the fold line connecting the second flap section with the rear section.

5. The container of claim 4, wherein the rear section is devoid of fold lines.

6. A cardboard blank for constructing a container for articles of clothing, the blank comprising:

a front section;

a first flap section;

an intermediate piece connecting the first flap section to the front section, the intermediate piece having a first juncture with the first flap section and a second juncture with the front section, said first and second junctures comprising fold lines;

a rear section;

a second flap section connected with the rear section by way of a fold line; and an intermediate section connecting the front section with the rear section, the intermediate section defining an opening adapted for gripping and viewing, wherein the front section has an edge and a popup flap unit defined at said edge by a curved cut line, said curved cut line also defining an opening in said front section, wherein said front section, said intermediate section and said rear section are adapted to wrap around an article of clothing, and wherein said popup flap unit is adapted to extend under a portion of the article of clothing such that a portion of said article of clothing is visible through the opening in said front section.

* * * * *